United States Patent [19]
Sommer et al.
[11] 3,955,939
[45] May 11, 1976

[54] EXTRACTIVE DISTILLATION OF ISOPROPYL ALCOHOL WITH AN ETHER SOLVENT RECOVERED FROM THE INITIAL FEED

[75] Inventors: August Sommer, Herne; Martin Urban, Gelsenkirchen-Buer, both of Germany

[73] Assignee: Veba-Chemie AG, Gelsenkirchen-Buer, Germany

[22] Filed: Oct. 4, 1973

[21] Appl. No.: 403,688

[30] Foreign Application Priority Data

Oct. 5, 1972 Germany ..... 2248841

[52] U.S. Cl. ..... 44/53; 203/18; 203/25; 203/63; 260/643 R; 203/71

[51] Int. Cl.[2] ..... C10L 1/02

[58] Field of Search ..... 203/12, 18, 14, 21, 203/25, 27, 57, 63, 71, 78, 75, 77, 81, 82, 84, 98; 260/641, 643 R, 643 D; 44/53

[56] References Cited

UNITED STATES PATENTS

| | | | |
|---|---|---|---|
| 1,488,605 | 4/1924 | Lichtenthaeler | 44/53 |
| 1,527,144 | 2/1925 | Lichtenthaeler | 44/53 |
| 2,384,796 | 9/1945 | Carmody et al. | 44/53 |
| 2,391,084 | 12/1945 | Carmody | 44/53 |
| 2,787,586 | 4/1957 | Catterall | 203/63 |
| 2,830,090 | 4/1958 | Teter et al. | 260/641 |
| 2,836,545 | 5/1958 | Catterall et al. | 203/27 |

*Primary Examiner*—Norman Yudkoff
*Assistant Examiner*—Frank Sever
*Attorney, Agent, or Firm*—Burgess, Dinklage & Sprung

[57] ABSTRACT

A water-free mixture of isopropyl alcohol, diisopropyl alcohol, diisopropyl ether and by-products is made by the catalytic hydration of propylene in the gaseous phase at temperatures of 140°–170°C under pressures of 25–40 atmospheres gauge. A water-to-propylene molar ratio of 0.1 to 0.25:1 is maintained in the hydration reaction. The crude product from the hydration reaction is dehydrated or dewatered in two columns without using a foreign withdrawing agent. Instead, diiosopropyl ether formed in the process itself is utilized as the withdrawing agent which is subsequently added to the water-free mixture together with additionally formed by-products. The water-free mixture formed according to the process can be used directly as an additive to gasoline fuel for motor vehicles.

3 Claims, 1 Drawing Figure

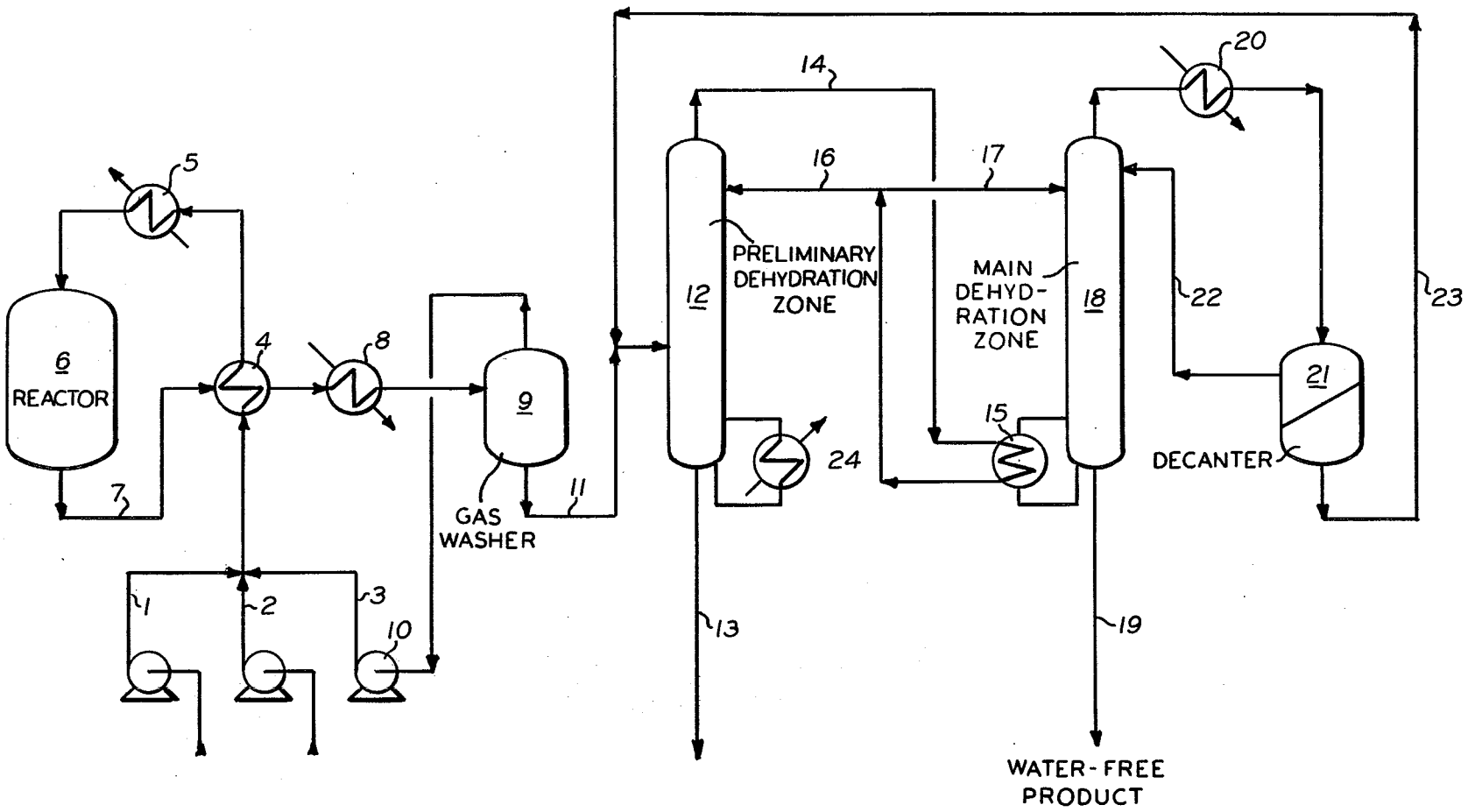
23
21
DECANTER
20
22
18
19
WATER-FREE PRODUCT
MAIN DEHYD-RATION ZONE
17
15
14
16
PRELIMINARY DEHYDRATION ZONE
24
12
13
11
9
GAS WASHER
8
10
3
4
2
5
1
6
REACTOR
7

EXTRACTIVE DISTILLATION OF ISOPROPYL ALCOHOL WITH AN ETHER SOLVENT RECOVERED FROM THE INITIAL FEED

BACKGROUND

The invention relates to the manufacture of anhydrous isopropyl alcohol suitable for fuel purposes.

The catalytic hydration of olefins in the gaseous phase at elevated temperature, elevated pressure and a molar water-to-olefin ratio of 0.5–1:1 has long been known. Phosphoric acid applied to a variety of support materials has proven to be an especially good catalyst for this purpose. Support materials involved are, for example, silicic acid, silicates, diatomaceous earth, aluminum silicates, etc.

The alcohols made in accordance with known catalytic hydration processes are used as solvents and for reactional as well as other special purposes. They have to be free of by-products, which necessitates expensive refinement. Thus, the crude alcohol produced in the synthesis must first be treated in columns where it is extracted by washing, and then refined, rectified and dried (dewatered) in four additional columns. Furthermore, for the removal of the water a foreign withdrawing agent (benzine/benzene, cyclohexane) must be used in order to remove the alcohol-water azeotrope.

It is known that isopropyl alcohol is an excellent fuel component due to its high octane number, its solubility in water, its engine-cleaning action and especially its exhaust-improving properties. Pure isopropyl alcohol as described above, however, in spite of its extremely attractive properties, has been used rarely or not at all in fuels for Otto-cycle engines, since it proves to be non-economical.

SUMMARY

It was therefore the object of the invention to develop an especially advantageous process for the manufacture of isopropyl alcohol suitable for use in fuels.

The subject matter of the invention is a process for the manufacture of a water-free mixture of isopropyl alcohol, diisopropyl ether and by-products, which will be suitable as a fuel component for motor vehicle gasoline, through the catalytic hydration of propylene in the gaseous phase at temperatures of 140° to 170°C and pressures of 25 to 40 atmospheres gauge, characterized by the fact that the molar ratio of water to olefin is 0.1 to 0.25:1 and the dewatering of the crude product is performed in only two columns, the withdrawing agent being, not a foreign withdrawing agent, but the diisopropyl ether formed in the process, which afterward is added to the end product together with all additionally formed by-products.

DESCRIPTION OF THE DRAWING

The present invention will be more fully understood from the following description taken in conjunction with the accompanying drawing which is a flow diagram incorporating suitable apparatus for carrying out the process of the invention.

DESCRIPTION

After the attainment in the dewatering column of the ether concentration required for the dissociation of the water-isopropyl alcohol azeotrope, therefore, the excess ether formed in the synthesis, along with all of the by-products that have been formed, such as especially n-propanol, acetone, hexanol and hydrocarbons, are added to the dewatered isopropanol. This increases the yield and, if the synthesis proportion is controlled in accordance with the invention, it is by no means disadvantageous for the end product, which at the most is to contain up to 10% diisopropyl ether and by-products. The low reaction temperatures have a favorable effect on the reaction of propylene to isopropanol, since the equilibrium is shifted to favor the formation of isopropanol. On account of the low partial pressure of the water vapor, however, low reaction temperatures could be established only if the water-to-olefin ratio were low, and this is made possible by using the ether that forms as a withdrawing agent and as a component of the end product, in accordance with the invention. Owing to the low water-to-olefin ratio and the low reaction temperatures it is possible to conduct the reaction in a manner that is extremely favorable from the standpoint of energy. Losses of withdrawing agent are replaced by the diisopropyl ether that is formed.

The process of the invention will now be explained with reference to the accompanying drawing.

Propylene is pumped through line 1 and water through line 2 into the recycled gas 3 containing substantially propylene. Stream 3 is preheated in the counterflow heat exchanger 4 and, after superheating in the heater 5, is delivered to the reactor 6 where it is reacted mainly to isopropyl alcohol. Additionally, however, diisopropyl ether and other by-products are also formed. The reaction product in line 7, after passing through the counterflow heat exchanger 4, is further cooled in cooler 8. A mixture of isopropanol, diisopropyl ether, by-products and excess water is delivered from the gas washer 9 through line 11 to the preliminary dewatering column 12.

Unreacted propylene, freed of reaction products, is recycled by the compressor 10 through line 3 to the reactor. In the dewatering column 12, the dilute crude alcohol produced in the synthesis, together with all of the by-products, is concentrated by rectification until it is close to the azeotropic concentration.

The isopropyl alcohol passes together with the by-products from the top of column 12 through line 14 to the boiler 15, while the waste water leaves the sump of the column through line 13.

Th column 12 is operated at sufficient pressure —about 3 to 7 atmospheres—for its vapors to be able to condense in heaters in the drying column 18 so as to utilize their heat.

A part of the head product from column 12, condensed in heater 15, is recycled through line 16 to column 12, while the remainder is carried through line 17 as input to column 18. The drying column 18 serves to dissociate the isopropanol-water azeotrope from the diisopropyl ether produced in the process. The latter concentrates at the head of column 18 in a concentration of about 60%, so that, after liquefaction of the vapots in condenser 20, separation into a virtually water-free upper layer and a lower layer containing the residual water may take place in the decanter 21. Whereas the water-free layer is carried back through line 22 into column 18, the water-containing layer is returned through line 23 to column 12, for the recovery of the organic products contained in it, column 12 obtaining its energy from the heater 24.

A water-free product, consisting of about 95% isopropyl alcohol, about 3% isopropyl ether and about 2% other by-products, leaves the sump of the column through line 19, and can be added directly to the gasoline fuel of Otto-cycle engines without further treatment.

EXAMPLE 1

At a reactor discharge temperature of 150°C and a pressure of 40 atmospheres gauge, and at a molar water-to-propylene ratio of 0.2:1, a crude alcohol is obtained from the reaction mixture, having the following composition:

| Composition of the Product in Line 11: | |
|---|---|
| Isopropanol | 14.20% |
| Water | 84.90% |
| Diisopropyl ether | 0.50% |
| By-products | 0.40% |

The by-products consist substantially of n-propanol, acetone, hexanol and hydrocarbons.

After the separation of water in column 12, a product is fed to column 18 having the following composition:

| Composition of the Product in Line 17: | |
|---|---|
| Isopropanol | 73.50% |
| Water | 20.10% |
| Diisopropyl ether | 2.40% |
| By-products | 4.00% |

The column 18 with its associated decanter 22 dissociates this mixture into the following partial streams:

| Composition of the Product in Line 19: | |
|---|---|
| Isopropanol | 95.50% |
| Water | — |
| Diisopropyl ether | 2.40% |
| By-products | 2.30% |
| **Composition of the Product in Line 22:** | |
| Isopropanol | 7.60% |
| Water | 1.00% |
| Diisopropyl ether | 65.40% |
| By-products | 26.00% |
| **Composition of the Product in Line 23:** | |
| Isopropanol | 13.00% |
| Water | 78.60% |
| Diisopropyl ether | 0.60% |
| By-products | 7.80% |

The catalyst used is phosphoric acid on a support material containing bentonite.

EXAMPLE 2

10% of the product described in Example 1 under "Composition of the Product in Line 19" is mixed with a regular gasoline containing 0.15 g/l of tetraethyl lead and having an ROZ (octane number) of 87.5. This increases the ROZ by 4 points to 91.5. At the same time the harmful components in the exhaust gas are reduced in the "Europa" tests as follows:

| | |
|---|---|
| Carbon monoxide: | Decrease from 3% to 2% |
| Hydrocarbons: | Decrease from 300 ppm to 250 ppm |

EXAMPLE 3

In a premium fuel containing 0.15 g/l of tetraethyl lead and having an ROZ of 96, upon the admixture of 10% of the product specified in Example 1 under "Composition of the Product in Line 19", the octane number increases from 96 to 98.5. The harmful components in the exhaust are at the same time reduced as follows:

| | |
|---|---|
| Carbon monoxide: | from 4% to 2.8% |
| Hydrocarbons: | from 450 ppm to 350 ppm. |

We claim:

1. Process for recovering a water-free mixture of isopropyl alcohol, diisopropyl ether and, as by-products, n-propanol, acetone, hexanol and hydrocarbons, from the catalytic hydration of propylene in the gaseous phase at temperatures of 140°–170°C and pressures of 25–40 atmospheres gauge which consists essentially of:

a. conducting the hydration reaction with a water-to-propylene molar ratio of 0.1 to 0.25 to produce a crude reaction product mixture containing water, isopropyl alcohol, diisopropyl ether and said by-products;

b. concentrating the crude reaction product from (a) by distillation in a first column, withdrawing water as the sump product until the mixture is close to the azeotropic concentration of the isopropyl alcohol-water azeotrope; and c. extractively distilling at least a portion of the concentrated mixture from (b) in a second column withdrawing said water-free mixture as the sump product and a mixture consisting of diisopropyl ether and said by-products formed in hydration step (a) prior to steps (b) and (c) and recycling said mixture of diisopropyl ether and by-products to the top of said second column, said diisopropyl ether formed exclusively as a byproduct of the hydration reaction serving as the extracting agent for the distillation in the second column, while eliminating the need for an external source of diisopropyl ether make-up.

2. Process of claim 1 wherein the first column is operated at a pressure of 3 to 7 atmospheres, the latent heat of head product from said first column serving to heat a reboiler for the second of said columns.

3. Process of claim 1 wherein a mixture of water, isopropyl alcohol, diisopropyl ether and higher alcohols is recovered from the second column and recycled to the first column.

* * * * *